US012385214B2

(12) United States Patent
Hammer

(10) Patent No.: US 12,385,214 B2
(45) Date of Patent: Aug. 12, 2025

(54) GNSS SUPPLEMENTED SLOPE CONTROL SYSTEM AND METHOD FOR A WORK VEHICLE

(71) Applicant: Deere & Company, Moline, IL (US)

(72) Inventor: August D. Hammer, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 360 days.

(21) Appl. No.: 18/174,750

(22) Filed: Feb. 27, 2023

(65) Prior Publication Data

US 2024/0287754 A1 Aug. 29, 2024

(51) Int. Cl.
*E02F 3/84* (2006.01)

(52) U.S. Cl.
CPC ..... *E02F 3/845* (2013.01)

(58) Field of Classification Search
CPC ..... E02F 3/845
See application file for complete search history.

(56) References Cited

U.S. PATENT DOCUMENTS

| | | | | |
|---|---|---|---|---|
| 5,933,346 | A * | 8/1999 | Brabec | E02F 3/437 340/684 |
| 6,389,345 | B2 * | 5/2002 | Phelps | E02F 3/845 701/50 |
| 9,328,479 | B1 | 5/2016 | Rausch et al. | |
| 9,988,787 | B1 | 6/2018 | Wang et al. | |
| 10,066,367 | B1 | 9/2018 | Wang et al. | |
| 2001/0029417 | A1 * | 10/2001 | Phelps | E02F 3/845 701/50 |
| 2016/0230367 | A1 | 8/2016 | Hendron et al. | |
| 2018/0209120 | A1 * | 7/2018 | Gentle | G01C 9/02 |
| 2018/0372498 | A1 * | 12/2018 | Nackers | E02F 3/434 |
| 2018/0373275 | A1 * | 12/2018 | Beschorner | G01S 17/86 |
| 2023/0358019 | A1 * | 11/2023 | Mason | E02F 3/844 |

FOREIGN PATENT DOCUMENTS

| | | | |
|---|---|---|---|
| DE | 102021204161 | A1 | 12/2021 |
| DE | 102021213706 | A1 | 8/2022 |

OTHER PUBLICATIONS

German Search Report issued in application No. 102024101103.3 dated Aug. 14, 2024, 14 pages.

* cited by examiner

*Primary Examiner* — Ashley L Redhead, Jr.

(57) ABSTRACT

A work vehicle including a chassis, a ground-engaging implement, an input device, a global positioning system, an implement sensor, and a controller. The implement movably connected to the chassis via a linkage assembly configured to allow the implement to be raised, lowered, and moved in a roll direction. The input device providing a bench surface, a desired cross slope, a desired mainfall slope, and a desired depth. The global positioning system configured to provide a chassis heading signal, a chassis inclination signal indicative of a main fall angle, and a chassis roll signal indicative of a cross slope angle. The sensor configured to provide a blade inclination signal and a blade roll signal. The controller configured to receive the signals, determine a distance error, and send a command to move the implement toward the desired mainfall slope and cross slope based on the distance error and towards the desired depth.

17 Claims, 7 Drawing Sheets

GNSS SUPPLEMENTED SLOPE CONTROL SYSTEM AND METHOD FOR A WORK VEHICLE

FIELD OF THE DISCLOSURE

The present disclosure relates to a work vehicle. An embodiment of the present disclosure relates to a system and method for supplementing the grade control of the work vehicle with a global navigation satellite system ("GNSS").

BACKGROUND OF THE DISCLOSURE

Work vehicles with ground-engaging implements may be used to shape and smooth ground surfaces. Such work vehicles may be supported by wheels or tracks which may encounter high and low spots on the ground as the work vehicles move, which cause the work vehicle to pitch forwards (downwards) or backwards (upwards). This pitching may be transmitted to the ground-engaging implement, causing it to move upwards and downwards relative to the ground, which may move the implement off a designated or desired grade or plane. This effect may be amplified for those work vehicles with a ground engaging implements in front of the work vehicles' tires or tracks, as the work vehicle may pitch forwards or backwards as it encounters the vertical variations created by the ground-engaging implement due to earlier work vehicle pitching. If this effect goes uncorrected by an operator, it may create a "washboard" type surface on the ground or otherwise inhibit the creation of a smooth plane or grade on the ground.

SUMMARY OF THE DISCLOSURE

According to an aspect of the present disclosure, a work vehicle may include a chassis and a ground-engaging blade movably connected to the chassis via a linkage assembly configured to allow the blade to be raised and lowered relative to the chassis and moved in a roll direction relative to the chassis. An input device may be included for providing a bench surface, a desired cross slope relative to the bench surface, a desired mainfall slope relative to the bench surface, and a desired depth relative to the bench surface. A global positioning system is communicatively coupled to the work vehicle. The global positioning system is configured for generating a chassis heading signal indicative of a location 150 of the work vehicle, a chassis inclination signal indicative of a main fall angle of the chassis relative to the bench surface, and a chassis roll signal indicative of a cross slope angle of the chassis relative to the bench surface. An implement sensor is configured to provide an implement inclination signal indicative of an angle of the implement relative to one of the chassis and the direction of gravity and an implement roll signal indicative of an angle of the implement in the roll direction relative to one of the chassis and the direction of gravity. A controller is configured to receive the bench surface, the desired cross slope, the desired mainfall slope, and the desired depth. The controller is further configured to receive the chassis heading signal, the chassis inclination signal, and the chassis roll signal. The controller is configured to receive the implement inclination signal and the implement roll signal. The controller is further yet configured to determine an inclination distance error based on the chassis inclination signal and the implement inclination signal, the inclination distance error indicative of a distance between the implement and the desired mainfall slope. The controller is configured to determine a roll distance error based on the chassis roll signal and the implement roll signal, the roll distance error indicative of a distance between the implement and the desired cross slope, and send a command to move the implement toward the desired mainfall slope and the desired cross slope, based on the inclination distance error and the roll distance error, and towards the desired depth.

According to another aspect of the present disclosure, a method of controlling a ground-engaging blade of a work vehicle is disclosed. The method includes receiving a bench surface, a desired cross slope relative to the bench surface, a desired mainfall slope relative to the bench surface, and a desired depth relative to the bench surface. The method further includes receiving a chassis inclination signal indicative of a main fall angle of a chassis of the work vehicle relative to the bench surface. The method further yet includes receiving an implement inclination signal indicative of an angle of the implement relative to one of the chassis and the direction of gravity. The method further includes receiving a chassis roll signal indicative of a cross slope angle of the chassis relative to the bench surface. The method further yet includes receiving an implement roll signal indicative of an angle of the implement in the roll direction relative to one of the chassis and the direction of gravity. The method further includes receiving a chassis heading signal indicative of a location 150 of the work vehicle. The method further yet includes determining an inclination distance error based on the chassis inclination signal and the implement inclination signal, the inclination distance error indicative of a distance between the implement and the desired mainfall slope. The method further includes determining a roll distance error based on the chassis roll signal and the implement roll signal, the roll distance error indicative of a distance between the implement and the desired cross slope. The method further yet includes controlling the work vehicle to move the implement toward the desired mainfall slope and the desired cross slope, based on the inclination distance error and the roll distance error, and towards the desired depth.

According to yet another aspect of the present disclosure, a crawler is disclosed. The crawler may include a chassis, a ground-engaging blade movably connected to the chassis by a linkage assembly configured to allow the blade to be raised and lowered relative to the chassis and moved in a roll direction relative to the chassis, a hydraulic cylinder, an electrohydraulic valve assembly configured to move the blade by directing hydraulic fluid to the hydraulic cylinder, an input device for providing a bench surface, a desired cross slope relative to the bench surface, a desired mainfall slope relative to the bench surface, and a desired depth relative to the bench surface. A global positioning system is provided that is communicatively coupled to the crawler. The global positioning system is configured for generating a chassis heading signal indicative of a location 150 of the crawler, a chassis inclination signal indicative of a main fall angle of the chassis relative to the bench surface, and a chassis roll signal indicative of a cross slope angle of the chassis relative to the bench surface. An implement sensor is coupled to the implement and configured to provide an implement inclination signal indicative of an angle of the implement relative to one of the chassis and the direction of gravity and an implement roll signal indicative of an angle of the implement in the roll direction relative to one of the chassis and the direction of gravity. A controller is configured to receive the bench surface, the desired cross slope, the desired mainfall slope, and the desired depth, receive the chassis heading signal, the chassis inclination signal, and the chassis roll signal, receive the implement inclination signal and the implement roll signal, determine an inclination distance error based on the chassis inclination signal and the implement inclination signal, the inclination distance error indicative of a distance between the implement and the desired mainfall slope, determine a roll distance error based on the chassis roll signal and the implement roll signal, the roll distance error indicative of a distance between the implement and the desired cross slope, and send a command to the electrohydraulic valve assembly to move the implement toward the desired mainfall slope and the desired cross slope, based on the inclination distance error and the roll distance error, and towards the desired depth.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION OF THE DRAWINGS

Figure 1:
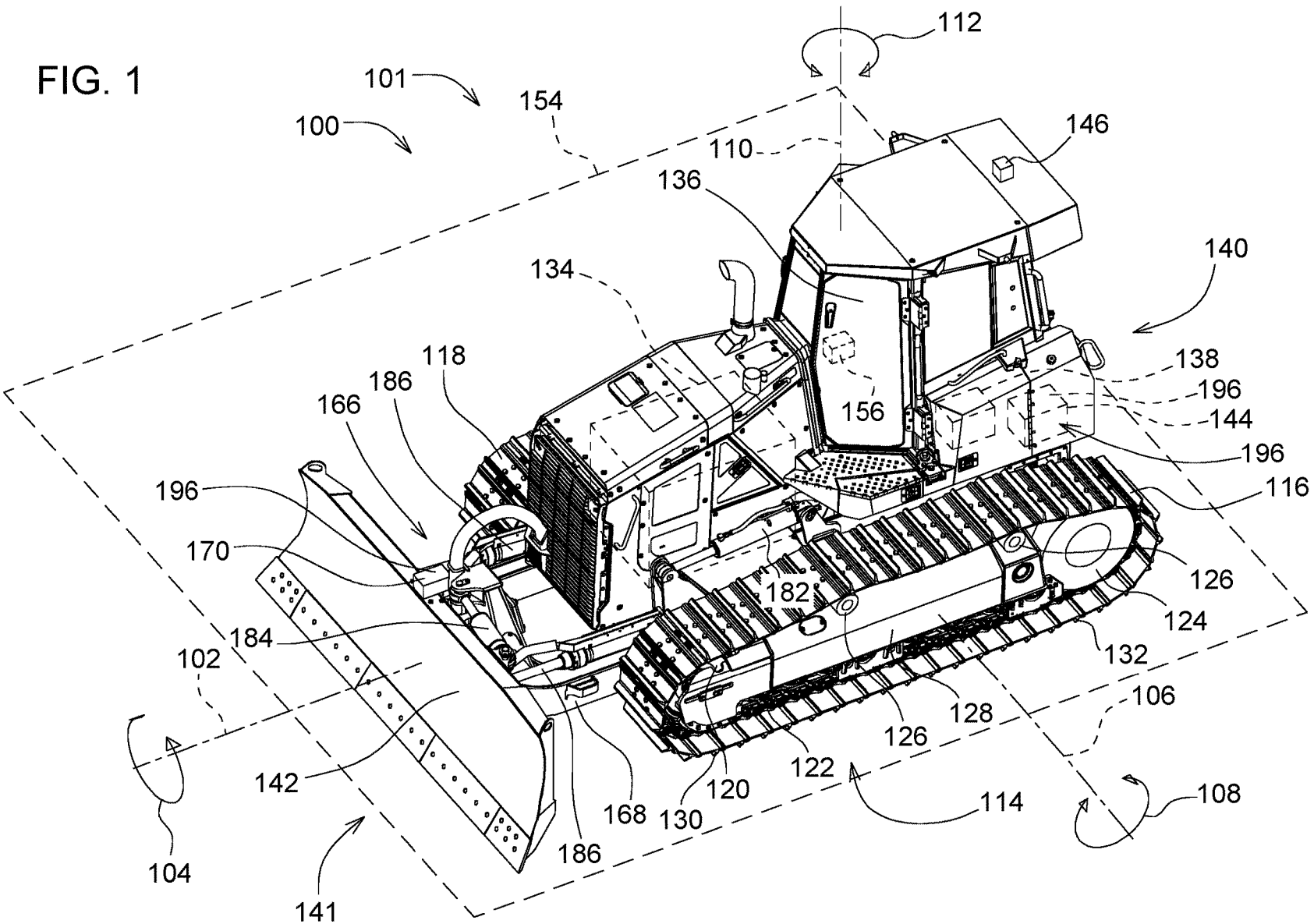
FIG. 1 is a perspective view of a work vehicle, for example a crawler.

FIG. 1 is a perspective view of work vehicle 100. Work vehicle 100 is illustrated as a crawler dozer, which may also be referred to as a crawler 101, but may be any work vehicle with a ground-engaging blade or work implement such as a compact track loader, motor grader 600 (FIG. 7), scraper, skid steer, and tractor, to name a few examples. Work vehicle 100 may be operated to engage the ground and cut and move material to achieve simple or complex features on the ground. As used herein, directions with regard to work vehicle 100 may be referred to from the perspective of an operator seated within an operator station 136: the left of work vehicle 100 is to the left of such an operator, the right of work vehicle 100 is to the right of such an operator, the front or fore of work vehicle 100 is the direction such an operator faces, the rear or aft of work vehicle 100 is behind such an operator, the top of work vehicle 100 is above such an operator, and the bottom of work vehicle 100 is below such an operator. While operating, work vehicle 100 may experience movement in three directions and rotation in three directions. Direction for work vehicle 100 may also be referred to with regard to longitude 102 or the longitudinal direction, latitude 106 or the lateral direction, and vertical 110 or the vertical direction. Rotation for work vehicle 100 may be referred to as roll 104 or the roll direction, pitch 108 or the pitch direction, and yaw 112 or the yaw direction or heading.

Work vehicle 100 is supported on the ground by undercarriage 114. Undercarriage 114 includes left track 116 and right track 118, which engage the ground and provide tractive force for work vehicle 100. Left track 116 and right track 118 may be comprised of shoes with grousers that sink into the ground to increase traction, and interconnecting components that allow the tracks to rotate about front idlers 120, track rollers 122, rear sprockets 124 and top idlers 126. Such interconnecting components may include links, pins, bushings, and guides, to name a few components. Front idlers 120, track rollers 122, and rear sprockets 124, on both the left and right sides of work vehicle 100, provide support for work vehicle 100 on the ground. Front idlers 120, track rollers 122, rear sprockets 124, and top idlers 126 are all pivotally connected to the remainder of work vehicle 100 and rotationally coupled to their respective tracks so as to rotate with those tracks. Track frame 128 provides structural support or strength to these components and the remainder of undercarriage 114.

Front idlers 120 are positioned at the longitudinal front of left track 116 and right track 118 and provide a rotating surface for the tracks to rotate about and a support point to transfer force between work vehicle 100 and the ground. Left track 116 and right track 118 rotate about front idlers 120 as they transition between their vertically lower and vertically upper portions parallel to the ground, so approximately half of the outer diameter of each of front idlers 120 is engaged with left track 116 or right track 118. This engagement may be through a sprocket and pin arrangement, where pins included in left track 116 and right track 118 are engaged by recesses in front idler 120 so as to transfer force. This engagement also results in the vertical height of left track 116 and right track 118 being only slightly larger than the outer diameter of each of front idlers 120 at the longitudinal front of left track 116 and right track 118. Frontmost engaging point 130 of left track 116 and right track 118 can be approximated as the point on each track vertically below the center of front idlers 120, which is the frontmost point of left track 116 and right track 118 which engages the ground. When work vehicle 100 encounters a ground feature when traveling in a forward direction, left track 116 and right track 118 may first encounter it at frontmost engaging point 130. If the ground feature is at a higher elevation than the surrounding ground surface (i.e., an upward ground feature), work vehicle 100 may begin pitching backward (which may also be referred to as pitching upward) when frontmost engaging point 130 reaches the ground feature. If the ground feature is at a lower elevation than the surrounding ground surface (i.e., a downward ground feature), work vehicle 100 may continue forward without pitching until the center of gravity of work vehicle 100 is vertically above the edge of the downward ground feature. At that point, work vehicle 100 may pitch forward (which may also be referred to as pitching downward) until frontmost engaging point 130 contacts the ground. In this embodiment, front idlers 120 are not powered and thus are freely driven by left track 116 and right track 118. In alternative embodiments, front idlers 120 may be powered, such as by an electric or hydraulic motor, or may have an included braking mechanism configured to resist rotation and thereby slow left track 116 and right track 118.

Track rollers 122 are longitudinally positioned between front idler 120 and rear sprocket 124 along the bottom left and bottom right sides of work vehicle 100. Each of track rollers 122 may be rotationally coupled to left track 116 or right track 118 through engagement between an upper surface of the tracks and a lower surface of track rollers 122. This configuration may allow track rollers 122 to provide support to work vehicle 100, and in particular may allow for the transfer of forces in the vertical direction between work vehicle 100 and the ground. This configuration also resists the upward deflection of left track 116 and right track 118 as they traverse an upward ground feature whose longitudinal length is less than the distance between front idler 120 and rear sprocket 124.

Rear sprockets 124 may be positioned at the longitudinal rear of left track 116 and right track 118 and, similar to front idlers 120, provide a rotating surface for the tracks to rotate about and a support point to transfer force between work vehicle 100 and the ground. Left track 116 and right track 118 rotate about rear sprockets 124 as they transition between their vertically lower and vertically upper portions parallel to the ground, so approximately half of the outer diameter of each of rear sprockets 124 is engaged with left track 116 or right track 118. This engagement may be through a sprocket and pin arrangement, where pins included in left track 116 and right track 118 are engaged by recesses in rear sprockets 124 so as to transfer force. This engagement also results in the vertical height of left track 116 and right track 118 being only slightly larger than the outer diameter of each of rear sprockets 124 at the longitudinal back or rear of left track 116 and right track 118. Rearmost engaging point 132 of left track 116 and right track 118 can be approximated as the point on each track vertically below the center of rear sprockets 124, which is the rearmost point of left track 116 and right track 118 which engages the ground. When work vehicle 100 encounters a ground feature when traveling in a reverse or backward direction, left track 116 and right track 118 may first encounter it at rearmost engaging point 132. If the ground feature is at a higher elevation than the surrounding ground surface, work vehicle 100 may begin pitching forward when rearmost engaging point 132 reaches the ground feature. If the ground feature is at a lower elevation than the surrounding ground surface, work vehicle 100 may continue backward without pitching until the center of gravity of work vehicle 100 is vertically above the edge of the downward ground feature. At that point, work vehicle 100 may pitch backward until rearmost engaging point 132 contacts the ground.

In this embodiment, each of rear sprockets 124 may be powered by a rotationally coupled hydraulic motor so as drive left track 116 and right track 118 and thereby control propulsion and traction for work vehicle 100. Each of the left and right hydraulic motors may receive pressurized hydraulic fluid from a hydrostatic pump whose direction of flow and displacement controls the direction of rotation and speed of rotation for the left and right hydraulic motors. Each hydrostatic pump may be driven by engine 134 of work vehicle 100, and may be controlled by an operator in operator station 136 issuing commands which may be received by controller 138 and communicated to the left and right hydrostatic pumps by controller 138. In alternative embodiments, each of rear sprockets 124 may be driven by a rotationally coupled electric motor or a mechanical system transmitting power from engine 134.

Top idlers 126 are longitudinally positioned between front idlers 120 and rear sprockets 124 along the left and right sides of work vehicle 100 above track rollers 122. Similar to track rollers 122, each of top idlers 126 may be rotationally coupled to left track 116 or right track 118 through engagement between a lower surface of the tracks and an upper surface of top idlers 126. This configuration may allow top idlers 126 to support left track 116 and right track 118 for the longitudinal span between front idler 120 and rear sprocket 124, and prevent downward deflection of the upper portion of left track 116 and right track 118 parallel to the ground between front idler 120 and rear sprocket 124.

Undercarriage 114 is affixed to, and provides support and tractive effort for, chassis 140 of work vehicle 100. Chassis 140 is the frame which provides structural support and rigidity to work vehicle 100, allowing for the transfer of force between implement 141, depicted as blade 142, and left track 116 and right track 118. In this embodiment, chassis 140 is a weldment comprised of multiple formed and joined steel members, but in alternative embodiments it may be comprised of any number of different materials or configurations. A chassis sensor 144 may be affixed to chassis 140 of work vehicle 100 and configured to provide a signal indicative of the movement and orientation of chassis 140. In alternative embodiments, chassis sensor 144 may not be affixed directly to chassis 140, but may instead be connected to chassis 140 through intermediate components or structures, such as rubberized mounts. In these alternative embodiments, chassis sensor 144 is not directly affixed to chassis 140 but is still connected to chassis 140 at a fixed relative position so as to experience the same motion as chassis 140.

Figure 2:
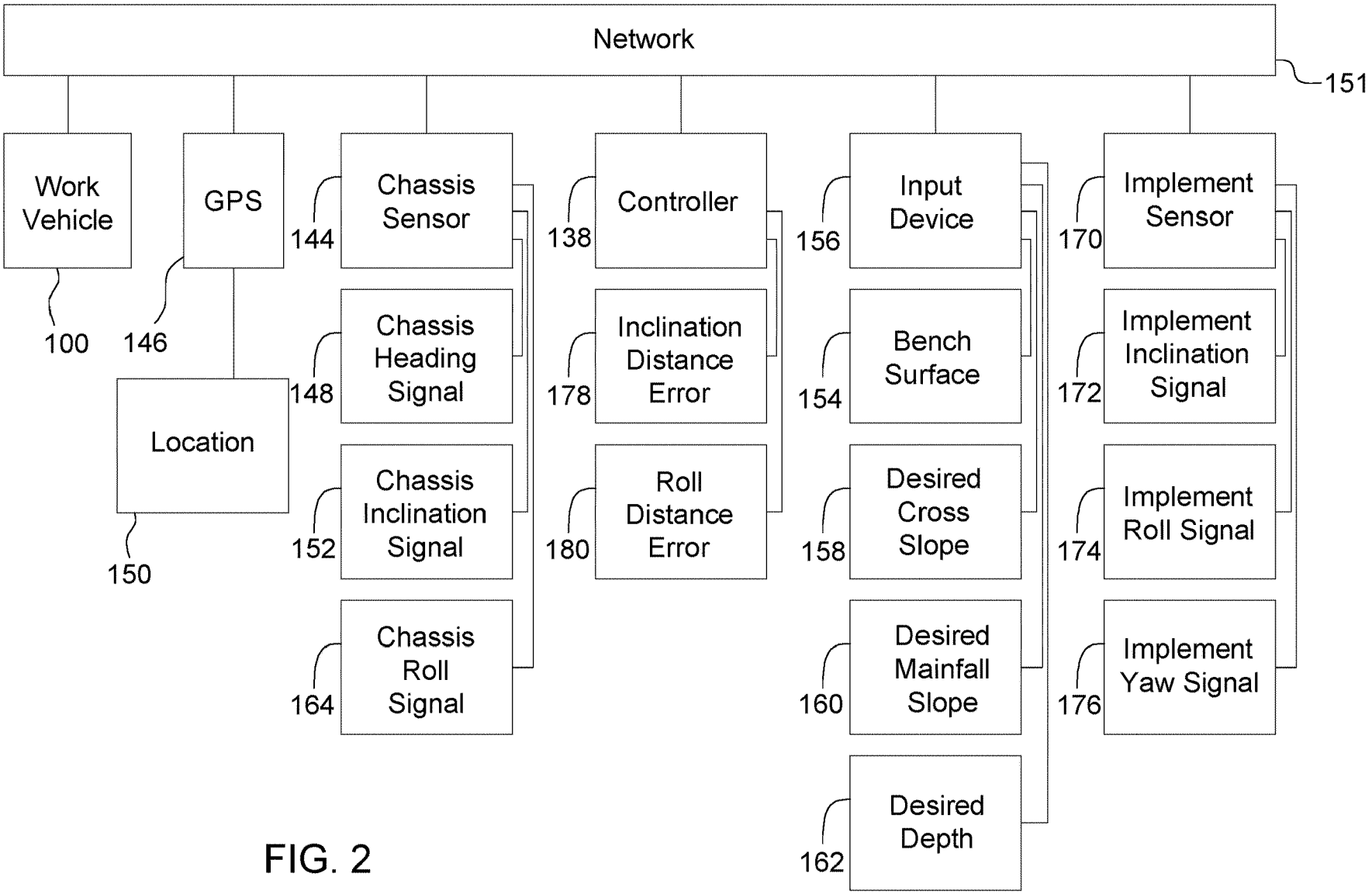
FIG. 2 is a schematic of a portion of the work vehicle.

The chassis sensor 144 may comprise at least one accelerometer and at least one gyroscope. Alternatively, the chassis sensor 144 may comprise an inertial measurement unit or IMU 196. The chassis sensor 144 may comprise a global positioning system ("GPS") 146. GPS 146 may comprise a Global Navigation Satellite System (GNSS), a terrestrial radio triangulation system, or any other system which is able to provide the location 150 of the work vehicle 100 in global or local coordinates. FIG. 2 illustratively shows that the work vehicle 100, the chassis sensor 144, the GPS 146, and the controller 138 may be connected over a network 151. Thus, computing architecture operates in a networked environment, where the network 151 includes any of a wide variety of different logical connections such as a local area network (LAN), wide area network (WAN), controller area network (CAN) near field communication network, satellite communication network, cellular networks, or a wide variety of other networks or combination of networks. It is also noted that the controller 138 can be deployed on the work vehicle 100 such that the controller 138 performs the operations described herein without a networked connection.

With continued reference to FIGS. 1-2, chassis sensor 144 or GPS 146 is configured to generate a chassis heading signal 148 indicative of a location 150 of the work vehicle 100. The chassis heading signal 148 is an angular measurement in the direction of yaw 112. The chassis heading signal 148 is indicative of a heading angle of a change from an initial heading to an updated heading.

Figure 3:
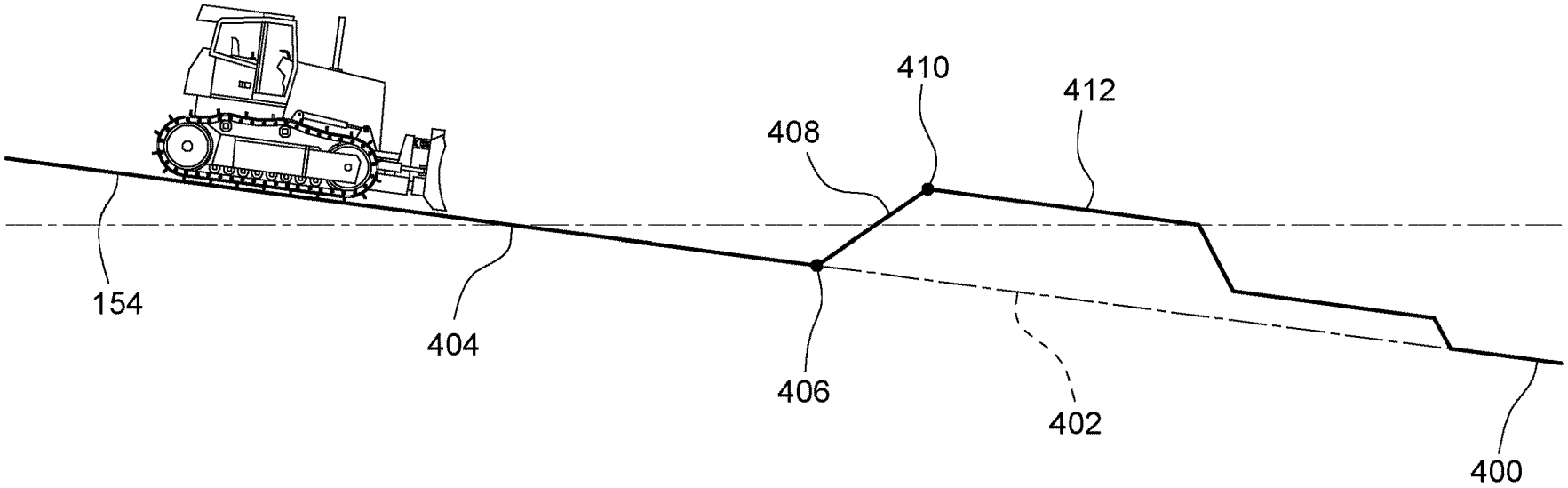
FIG. 3 is an illustration of a ground profile created by the crawler as it drives over ground features.

Chassis sensor 144 or GPS 146 is configured to generate a chassis inclination signal 152 indicative of a main fall angle, or inclination, of the chassis 140 relative to gravity or a bench surface 154 (FIG. 3). The bench surface 154 may be provided via an input device 156 by an operator. The bench surface 154 may be a surface or plane that is defined by a roll 104 and pitch 108 relative to gravity and a vertical 110, above sea level for example, that defines a depth. The bench surface 154 may be a surface that the work vehicle 100 is currently positioned on. The input device 156 may be a joystick. The chassis inclination signal 152 is an angular measurement in the direction of pitch 108. Controller 138 may actuate blade 142 based on this chassis inclination signal 152. As used herein, "based on" means "based at least in part on" and does not mean "based solely on," such that it neither excludes nor requires additional factors. Chassis sensor 144 may also be configured to provide a signal or signals indicative of other positions or velocities of chassis 140, including, its angular position, velocity, or acceleration in a direction such as the direction of roll 104, pitch 108, yaw 112, or its linear acceleration in a direction such as the direction of longitude 102, latitude 106, and vertical 110. Chassis sensor 144 may be configured to directly measure inclination, measure angular velocity and integrate to arrive at inclination, or measure inclination and derive to arrive at angular velocity. Input device 156 may also be configured to provide a desired cross slope 158 relative to the bench surface 154, a desired mainfall slope 160 relative to the bench surface 154, and a desired depth 162 relative to the bench surface 154.

Chassis sensor 144 or GPS 146 is also configured to generate a chassis roll signal 164 indicative of a cross slope angle of the chassis 140 relative to the bench surface 154 or relative to the direction of gravity. The chassis roll signal 164 is an angular measurement in the direction of roll 104.

Implement 141 depicted as blade 142 may engage the ground or material to move or shape it. Blade 142 may be used to move material from one location to another and to create features on the ground, including flat areas, grades, hills, roads, or more complexly shaped features. In this embodiment, blade 142 of work vehicle 100 may be referred to as a six-way blade, six-way adjustable blade, or power-angle-tilt (PAT) blade. Blade 142 may be hydraulically actuated to move vertically up or vertically down (which may also be referred to as blade lift, or raise and lower), roll left or roll right (which may be referred to as blade tilt, or tilt left and tilt right), and yaw left or yaw right (which may be referred to as blade angle, or angle left and angle right). Alternative embodiments may utilize a different implement 141 or a blade 142 with fewer hydraulically controlled degrees of freedom, such as a 4-way blade that may not be angled, or actuated in the direction of yaw 112.

Blade 142 is movably connected to chassis 140 of work vehicle 100 through linkage assembly 166, which supports and actuates blade 142 and is configured to allow blade 142 to be raised or lowered relative to chassis 140 (i.e., moved in the direction of vertical 110). Linkage assembly 166 may include multiple structural members to carry forces between blade 142 and the remainder of work vehicle 100 and may provide attachment points for hydraulic cylinders which may actuate blade 142 in the lift, tilt, and angle directions.

Linkage assembly 166 includes c-frame 168, a structural member with a C-shape positioned rearward of blade 142, with the C-shape open toward the rear of work vehicle 100. Each rearward end of c-frame 168 is pivotally connected to chassis 140 of work vehicle 100, such as through a pin-bushing joint, allowing the front of c-frame 168 to be raised or lowered relative to work vehicle 100 about the pivotal connections at the rear of c-frame 168. The front portion of c-frame 168, which is approximately positioned at the lateral center of work vehicle 100, connects to blade 142 through a ball-socket joint. This allows blade 142 three degrees of freedom in its orientation relative to c-frame 168 (lift-tilt-angle) while still transferring rearward forces on blade 142 to the remainder of work vehicle 100.

An implement sensor 170 may comprise at least one accelerometer and at least one gyroscope. Alternatively, the implement sensor 170 may comprise an inertial measurement unit or IMU 196. The implement sensor 170 may be affixed to implement 141 or 142 above the ball-socket joint connecting blade 142 to c-frame 168. Implement sensor 170, like chassis sensor 144, may be configured to measure angular position (inclination or orientation), velocity, or acceleration, or linear acceleration. Implement sensor 170 may provide an implement inclination signal 172, which indicates the angle of blade 142 relative to one of the chassis 140 and the direction of gravity. The implement sensor 170 may be configured to provide an implement roll signal 174 indicative of an angle of the implement 141 in the roll 104 direction relative to one of the chassis 140 and the direction of gravity. The implement sensor 170 may be configured to provide an implement yaw signal 176 indicative of an angle of the implement 141 in the direction of yaw 112 relative to the chassis 140.

In alternative embodiments, an implement sensor 170 may be configured to instead measure an angle of linkage assembly 166, such as an angle between linkage assembly 166 and chassis 140, in order to determine a position of blade 142. In other alternative embodiments, implement sensor 170 may be configured to measure a position of blade 142 by measuring a different angle, such as one between linkage assembly 166 and blade 142, or the linear displacement of a cylinder attached to linkage assembly 166 or blade 142. In alternative embodiments, implement sensor 170 may not be affixed directly to blade 142, but may instead be connected to blade 142 through intermediate components or structures, such as rubberized mounts. In these alternative embodiments, implement sensor 170 is not directly affixed to blade 142 but is still connected to blade 142 at a fixed relative position so as to experience the same motion as blade 142.

Controller 138 is configured to receive the bench surface 154, the desired cross slope 158, the desired mainfall slope 160, and the desired depth 162, receive the chassis heading signal 148, the chassis inclination signal 152, and the chassis roll signal 164, receive the implement inclination signal 172 and the implement roll signal 174, determine an inclination distance error 178 based on the chassis inclination signal 152 and the implement inclination signal 172, the inclination distance error 178 indicative of a distance between the implement 141 and the desired mainfall slope 160, determine a roll distance error 180 based on the chassis roll signal 164 and the implement roll signal 174, the roll distance error 180 indicative of a distance between the implement 141 and the desired cross slope 158, and send a command to move the implement 141 toward the desired mainfall slope 160 and the desired cross slope 158, based on the inclination distance error 178 and the roll distance error 180, and towards the desired depth 162.

Blade 142 may be raised or lowered relative to work vehicle 100 by the actuation of lift cylinders 182, which may raise and lower c-frame 168 and thus raise and lower blade 142, which may also be referred to as blade lift. For each of lift cylinders 182, the rod end is pivotally connected to an upward projecting clevis of c-frame 168 and the head end is pivotally connected to the remainder of work vehicle 100 just below and forward of operator station 136. The configuration of linkage assembly 166 and the positioning of the pivotal connections for the head end and rod end of lift cylinders 182 results in the extension of lift cylinders 182 lowering blade 142 and the retraction of lift cylinders 182 raising blade 142. In alternative embodiments, blade 142 may be raised or lowered by a different mechanism, or lift cylinders 182 may be configured differently, such as a configuration in which the extension of lift cylinders 182 raises blade 142 and the retraction of lift cylinders 182 lowers blade 142.

Blade 142 may be tilted relative to work vehicle 100 by the actuation of tilt cylinder 184, which may also be referred to as moving blade 142 in the direction of roll 104. For tilt cylinder 184, the rod end is pivotally connected to a clevis positioned on the back and left sides of blade 142 above the ball-socket joint between blade 142 and c-frame 168 and the head end is pivotally connected to an upward projecting portion of linkage assembly 166. The positioning of the pivotal connections for the head end and the rod end of tilt cylinder 184 result in the extension of tilt cylinder 184 tilting blade 142 to the left or counterclockwise when viewed from operator station 136 and the retraction of tilt cylinder 184 tilting blade 142 to the right or clockwise when viewed from operator station 136. In alternative embodiments, blade 142 may be tilted by a different mechanism (e.g., an electrical or hydraulic motor) or tilt cylinder 184 may be configured differently, such as a configuration in which it is mounted vertically and positioned on the left or right side of blade 142, or a configuration with two tilt cylinders 184.

Blade 142 may be angled relative to work vehicle 100 by the actuation of angle cylinders 186, which may also be referred to as moving blade 142 in the direction of yaw 112. For each of angle cylinders 186, the rod end is pivotally connected to a clevis of blade 142 while the head end is pivotally connected to a clevis of c-frame 168. One of angle cylinders 186 is positioned on the left side of work vehicle 100, left of the ball-socket joint between blade 142 and c-frame 168, and the other of angle cylinders 186 is positioned on the right side of work vehicle 100, right of the ball-socket joint between blade 142 and c-frame 168. This positioning results in the extension of the left of angle cylinders 186 and the retraction of the right of angle cylinders 186 angling blade 142 rightward, or yawing blade 142 clockwise when viewed from above, and the retraction of left of angle cylinder 186 and the extension of the right of angle cylinders 186 angling blade 142 leftward, or yawing blade 142 counterclockwise when viewed from above. In alternative embodiments, blade 142 may be angled by a different mechanism or angle cylinders 186 may be configured differently.

Due to the geometry of linkage assembly 166 in this embodiment, blade 142 is not raised or lowered in a perfectly vertical line with respect to work vehicle 100. Instead, a point on blade 142 would trace a curve as blade 142 is raised and lowered. This means that the vertical component of the velocity of blade 142 is not perfectly proportional to the linear velocity with which lift cylinders 182 are extending or retracting, and the vertical component of blade 142's velocity may vary even when the linear velocity of lift cylinders 182 is constant. This also means that lift cylinders 182 have a mechanical advantage which varies depending on the position of linkage assembly 166. Given a kinematic model of blade 142 and linkage assembly 166 (e.g., formula(s) or table(s) providing a relationship between the position and/or movement of portions of blade 142 and linkage assembly 166) and the state of blade 142 and linkage assembly 166 (e.g., sensor(s) sensing one or more positions, angles, or orientations of blade 142 or linkage assembly 166, such as implement sensor 170), at least with respect to blade lift, controller 138 may compensate for such non-linearity. Incomplete or simplified kinematic models may be used if there is a need to only focus on particular motion relationships (e.g., only those affecting blade lift) or if only limited compensation accuracy is desired. Controller 138 may utilize this compensation and a desired velocity, for example a command to raise blade 142 at a particular vertical velocity, to issue a command that may achieve a flow rate into lift cylinders 182 that results in blade 142 being raised at the particular vertical velocity regardless of the current position of linkage assembly 166. For example, controller 138 may issue commands which vary the flow rate into lift cylinders 182 in order to achieve a substantially constant vertical velocity of blade 142.

Similarly, due to the positioning of tilt cylinder 184 and angle cylinders 186 and the configuration of their connection to blade 142, the angular velocity of blade tilt and angle is not perfectly proportional to the linear velocity of tilt cylinder 184 and angle cylinders 186, respectively, and the angular velocity of tilt and angle may vary even when the linear velocity of tilt cylinder 184 and angle cylinders 186, respectively, is constant. This also means that tilt cylinder 184 and angle cylinders 186 each has a mechanical advantage which varies depending on the position of blade 142. Much like with lift cylinders 182, given a kinematic model of blade 142 and linkage assembly 166, and the state of blade 142 and linkage assembly 166, at least with respect to blade tilt and angle, controller 138 may compensate for such non-linearity. Incomplete or simplified kinematic models may be used if there is a need to only focus on particular motion relationships (e.g., only those affecting blade tilt and angle) or if only limited compensation accuracy is required. Controller 138 may utilize this compensation and a desired angular velocity, for example a command to tilt or angle blade 142 at a particular angular velocity, to issue commands that may vary the flow rate into tilt cylinder 184 or angle cylinders 186 to result in blade 142 being tilted or angled at the particular angular velocity regardless of the current position of blade 142 or linkage assembly 166.

In alternative embodiments, blade 142 may be connected to the remainder of work vehicle 100 in a manner which tends to make the blade lift velocity (in direction of vertical 110), tilt angular velocity (in the direction of roll 104), or angle angular velocity (in the direction of yaw 112) proportional to the linear velocity of lift cylinders 182, tilt cylinder 184, or angle cylinders 186, respectively. This may be achieved with particular designs of linkage assembly 166 and positioning of the pivotal connections of lift cylinders 182, tilt cylinder 184, and angle cylinders 186. In such alternative embodiments, controller 138 may not need to compensate for non-linear responses of blade 142 to the actuation of lift cylinders 182, tilt cylinder 184, and angle cylinders 186, or the need for compensation may be reduced.

Each of lift cylinders 182, tilt cylinder 184, and angle cylinders 186 is a double acting hydraulic cylinder. One end of each cylinder may be referred to as a head end, and the end of each cylinder opposite the head end may be referred to as a rod end. Each of the head end and the rod end may be fixedly connected to another component or, as in this embodiment, pivotally connected to another component, such as a through a pin-bushing or pin-bearing coupling, to name but two examples of pivotal connections. As a double acting hydraulic cylinder, each may exert a force in the extending or retracting direction. Directing pressurized hydraulic fluid into a head chamber of the cylinders will tend to exert a force in the extending direction, while directing pressurized hydraulic fluid into a rod chamber of the cylinders will tend to exert a force in the retracting direction. The head chamber and the rod chamber may both be located within a barrel of the hydraulic cylinder, and may both be part of a larger cavity which is separated by a movable piston connected to a rod of the hydraulic cylinder. The volumes of each of the head chamber and the rod chamber change with movement of the piston, while movement of the piston results in extension or retraction of the hydraulic cylinder. The control of these cylinders will be described in further detail with regard to FIG. 2.

Figure 4:
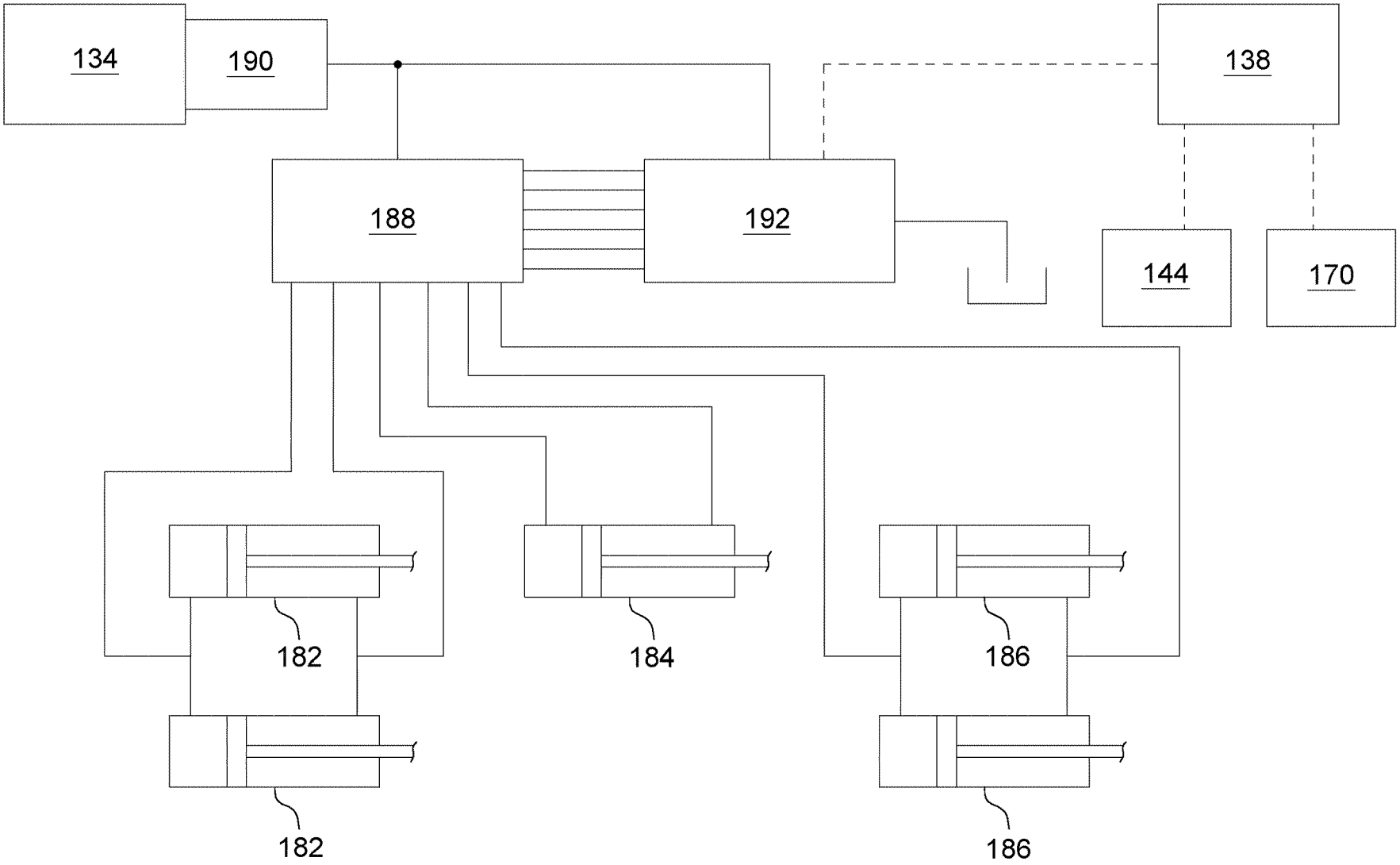
FIG. 4 is a schematic of a portion of a hydraulic system of the work vehicle.

FIG. 4 is a schematic of a portion of a system for controlling the hydraulic cylinder, the system including hydraulic and electrical components. Each of lift cylinders 182, tilt cylinder 184, and angle cylinders 186 is hydraulically connected to hydraulic control valve 188, which may be positioned in an interior area of work vehicle 100. Hydraulic control valve 188 may also be referred to as a valve assembly or manifold. Hydraulic control valve 188 receives pressurized hydraulic fluid from hydraulic pump 190, which may be rotationally connected to engine 134, and directs such fluid to lift cylinders 182, tilt cylinder 184, angle cylinders 186, and other hydraulic circuits or functions of work vehicle 100. Hydraulic control valve 188 may meter such fluid out, or control the flow rate of hydraulic fluid to each hydraulic circuit to which it is connected. In alternative embodiments, hydraulic control valve 188 may not meter such fluid out but may instead only selectively provide flow paths to these functions while metering is performed by another component (e.g., a variable displacement hydraulic pump) or not performed at all. Hydraulic control valve 188 may meter such fluid out through a plurality of spools, whose positions control the flow of hydraulic fluid, and other hydraulic logic. The spools may be actuated by solenoids, pilots (e.g., pressurized hydraulic fluid acting on the spool), the pressure upstream or downstream of the spool, or some combination of these and other elements.

In the embodiment illustrated in FIG. 1, the spools of hydraulic control valve 188 are shifted by pilots whose pressure is controlled, at least in part, by electrohydraulic pilot valve 192 in communication with controller 138. Electrohydraulic pilot valve 192 is positioned within an interior area of work vehicle 100 and receives pressurized hydraulic fluid from a hydraulic source and selectively directs such fluid to pilot lines hydraulically connected to hydraulic control valve 188. In this embodiment hydraulic control valve 188 and electrohydraulic pilot valve 192 are separate components, but in alternative embodiments the two valves may be integrated into a single valve assembly or manifold. In this embodiment, the hydraulic source is hydraulic pump 190. In alternative embodiments, a pressure reducing valve may be used to reduce the pressure of pressurized hydraulic fluid provided by hydraulic pump 190 to a set pressure, for example 600 pounds per square inch, for usage by electrohydraulic pilot valve 192. In the embodiment illustrated in FIG. 2, individual valves within electrohydraulic pilot valve 192 reduce the pressure from the received hydraulic fluid via solenoid-actuated spools which may drain hydraulic fluid to a hydraulic reservoir. In this embodiment, controller 138 actuates these solenoids by sending a specific current to each (e.g., 600 mA). In this way, controller 138 may actuate blade 142 by issuing electrical commands signals to electrohydraulic pilot valve 192, which in turn provides hydraulic signals (pilots) to hydraulic control valve 188, which shift spools to direct hydraulic flow from hydraulic pump 190 to actuate lift cylinders 182, tilt cylinder 184, and angle cylinders 186. In this embodiment, controller 138 is in direct communication with electrohydraulic pilot valve 192 via electrical signals sent through a wire harness and is indirectly in communication with hydraulic control valve 188 via electrohydraulic pilot valve 192.

Controller 138, which may be referred to as a vehicle control unit (VCU), is in communication with a number of components on work vehicle 100, including hydraulic components such as electrohydraulic pilot valve 192, electrical components such as operator inputs within operator station 136, chassis sensor 144, implement sensor 170, and other components. Controller 138 is electrically connected to these other components by a wiring harness such that messages, commands, and electrical power may be transmitted between controller 138 and the remainder of work vehicle 100. Controller 138 may be connected to some of these sensors or other controllers, such as an engine control unit (ECU), through a controller area network (CAN). Controller 138 may then send and receive messages over the CAN to communicate with other components on the CAN.

In alternative embodiments, controller 138 may send a command to actuate blade 142 in a number of different manners. As one example, controller 138 may be in communication with a valve controller via a CAN and may send command signals to the valve controller in the form of CAN messages. The valve controller may receive these messages from controller 138 and send current to specific solenoids within electrohydraulic pilot valve 192 based on those messages. As another example, controller 138 may actuate blade 142 by actuating an input in operator station 136. For example, an operator may use input device 156 (e.g., joystick) to issue commands to actuate blade 142, and the joystick may generate hydraulic pressure signals, pilots, which are communicated to hydraulic control valve 188 to cause the actuation of blade 142. In such a configuration, controller 138 may be in communication with electrical devices (e.g., solenoids, motors) which may actuate a joystick in operator station 136. In this way, controller 138 may actuate blade 142 by actuating these electrical devices instead of communicating signals to electrohydraulic pilot valve 192.

Figure 5:
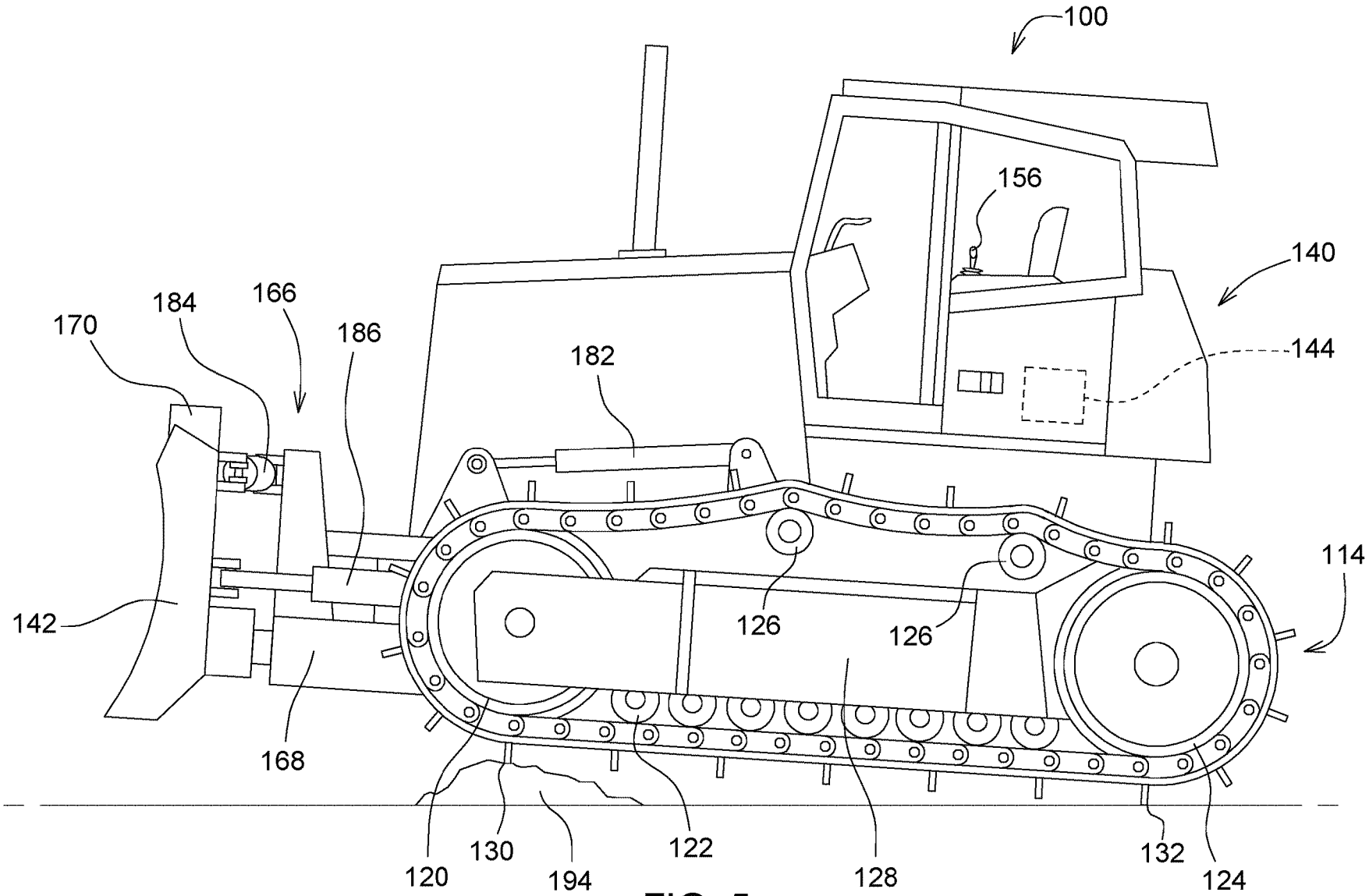
FIG. 5 is a left side view of the crawler driving over a ground feature.

FIG. 5 is a left side view of work vehicle 100 as work vehicle 100 drives over ground feature 194, which in this example is a ground feature at a higher elevation than the surrounding ground surface (e.g., an upward ground feature). As work vehicle 100 drives over ground feature 194, frontmost engaging point 130 is the first point on left track 116 and right track 118 which substantially engages ground feature 194. As work vehicle 100 engages ground feature 194 at frontmost engaging point 130, work vehicle 100 begins to pitch upward or pitch backward as the front of work vehicle 100 rises on ground feature 194 relative to the rear of work vehicle 100. When pitching upwards or backwards, work vehicle 100 will tend to pitch about rearmost engaging point 132.

During this pitching, chassis sensor 144 may send a chassis inclination signal 152 indicative of the angle of chassis 140 relative to the direction of gravity (i.e., orientation in the direction of pitch 108) as well as a chassis pitch signal indicative of an angular velocity of chassis 140 in the direction of pitch 108. The chassis inclination signal 152 and chassis pitch signal will indicate an inclination and velocity in a first direction, angled and pitching upwards, as opposed to the chassis inclination signal 152 and chassis pitch signal indicating an inclination and velocity in a second direction, angled and pitching downwards. In this embodiment, chassis inclination signal 152 and chassis pitch signal from chassis sensor 144 to controller 138 may indicate values within a range for which values in one half of the range indicate angles and angular velocities in the first direction and values in the other half of the range indicate angles and angular velocities in the second direction. During the pitching, chassis sensor 144 may also send the chassis roll signal 164 and the chassis heading signal 148. The signals from chassis sensor 144 may be received by the controller 138.

Similarly, implement sensor 170 may send an implement inclination signal 172 indicative of the angle of blade 142 relative to the direction of gravity (i.e., orientation in the direction of pitch 108) as well as an implement pitch signal indicative of an angular velocity of blade 142 in the direction of pitch 108. The implement inclination signal 172 and implement pitch signal will indicate an inclination and velocity in a first direction, angled and pitching upwards, as opposed to the implement inclination signal 172 and implement pitch signal indicating an inclination and velocity in a second direction, angled and pitching downwards. In this embodiment, implement inclination signal 172 and implement pitch signal from implement sensor 170 to controller 138 may indicate values within a range for which values in one half of the range indicate angles and angular velocities in the first direction and values in the other half of the range indicate angles and angular velocities in the second direction. During the pitching, implement sensor 170 may also send the implement roll signal 174 and the implement yaw signal 176. The signals from the implement sensor 170 may be received by the controller 138.

As work vehicle 100 continues to drive over ground feature 194, frontmost engaging point 130 would cease to engage the ground and instead would remain suspended above the ground by a distance determined in part by the height of ground feature 194 relative to the surrounding ground surface and the position of work vehicle 100 on ground feature 194. At this point, although ground feature 194 is an upward ground feature, it has the effect of a downward ground feature at a lower elevation than the surrounding ground surface. Specifically, the area just past ground feature 194 is lower than ground feature 194. As the center of gravity for work vehicle 100 passes over the top of ground feature 194, work vehicle 100 will pitch forwards and rearmost engaging point 132 will leave the ground surface while frontmost engaging point 130 will fall until it contacts the ground surface.

During the process of work vehicle 100 driving over ground feature 194, blade 142 will rise and fall relative to the ground surface due to the pitching of work vehicle 100. As work vehicle 100 pitches backward, blade 142 will rise as c-frame 168 pitches backward with work vehicle 100, and as work vehicle 100 pitches forward, blade 142 will fall as c-frame 168 pitches forward with work vehicle 100. If the operator of work vehicle 100 fails to correct for ground feature 194 by commanding blade 142 to rise or fall in a manner that counteracts the effect of ground feature 194 on the height of blade 142, work vehicle 100 will create vertical variations on the ground surface instead of a smooth surface, such as a hill and a valley. As work vehicle 100 drives over this newly created hill and valley on the ground surface, blade 142 will once again be raised and lowered as work vehicle 100 pitches backward and forward, creating further vertical variations. This series of hills and valleys may be referred to as a "washboard" pattern. In addition to creating this pattern, the pitching of work vehicle 100 will also interrupt efforts to maintain a uniform grade. An operator of work vehicle 100 may target a particular grade (e.g., 2%) and if traveling up or down the grade, the pitching of work vehicle 100 will create segments where the actual grade is steeper or shallower than the target grade.

While this is occurring, chassis sensor 144 and implement sensor 170 send the chassis inclination signal 152, chassis pitch signal, chassis roll signal 164, chassis heading signal 148, implement inclination signal 172, implement roll signal 174, implement yaw signal 176, and implement pitch signal to controller 138. Controller 138 may also receive signals from controls in operator station 136 which the operator may use to issue commands, for example a command to raise or lower blade 142. If controller 138 does not sense a command from the operator to raise or lower blade 142, but receives a signal from chassis sensor 144 or implement sensor 170 indicating that chassis 140 or blade 142 is pitching, controller 138 may issue a command to electrohydraulic pilot valve 192 to raise or lower blade 142 to counteract the effect from the pitch. In this manner, controller 138 may attempt to mitigate or attenuate the effect of pitching and ground features and thereby create a smoother ground surface, as further described with regard to FIG. 6.

In this embodiment, each of chassis sensor 144 and implement sensor 170 comprise three accelerometers, each measuring linear acceleration in one of three perpendicular directions, and three gyroscopes, each measuring angular velocity in one of three perpendicular directions. In this way, chassis sensor 144 and implement sensor 170 may each directly measure linear acceleration or angular velocity in any direction, including the directions of longitude 102, latitude 106, vertical 110, roll 104, pitch 108, and yaw 112. The linear acceleration of each accelerometer may be filtered to remove short term accelerations or otherwise analyzed to determine the direction of gravity, which exerts a constant acceleration of approximately 9.81 meters per square second on chassis sensor 144 and implement sensor 170. The measurements from the accelerometers and gyroscopes of chassis sensor 144 and implement sensor 170 may be combined or analyzed together to improve the accuracy and/or reduce the latency with which the direction of gravity may be determined. For example, the accelerometers may measure the direction of gravity with high accuracy over a period of time sufficient to remove the effects of short-term accelerations, while the gyroscopes may measure changes to the direction of the sensor relative to the direction of gravity very quickly but be subject to drift if these changes are integrated to determine the direction and error is allowed to accumulate. Chassis sensor 144 and implement sensor 170 may each be an IMU "inertial measurement unit" 196.

FIG. 3 illustrates how controller 138 may issue commands to move blade 142 so as to counteract pitching, such as may happen when the tracks of work vehicle 100 engage ground features. As work vehicle 100 travels in a forward direction, it creates profile 400, which illustrates a cross-section of the ground which work vehicle 100 is working. Controller 138 may determine a target grade, including based on an operator directly entering a desired cross slope 158, a desired mainfall slope 160, a desired depth 162, and a bench surface 154 or a grade (e.g., 2%) via the input device 156 or by recording the current grade after an operator is done issuing blade commands. This target grade, which may also be referred to as a target angle or target plane, is illustrated by line 402 in FIG. 3. While line 402 illustrates the target grade while work vehicle 100 is on slope 404, it does not represent the target grade while work vehicle 100 is on different portions of profile 400.

As work vehicle 100 travels forward, it may create slope 404 which is at the target grade. As work vehicle 100 continues travelling forward, it may encounter a ground feature (e.g., a rock) at point 406, at which point work vehicle 100 will begin pitching upwards. Absent a counteracting command, this may cause blade 142 to pitch upwards and create slope 408, which is at a different grade than target grade. Controller 138, receiving chassis inclination signal 152, chassis pitch signal, chassis roll signal 164, chassis heading signal 148, implement inclination signal 172, implement roll signal 174, implement yaw signal 176, and implement pitch signal, may detect this change and issue commands to move the blade 142 downwards to counteract the ground feature encountered at point 406. By point 410, controller 138 may have corrected for the ground feature so that blade 142 of work vehicle 100 creates slope 412, which is once again at the target grade. Slope 412 is parallel to slope 404, but at a different elevation due to the increase in elevation by work vehicle 100 overall. If line 402 were updated to reflect the current target slope of work vehicle 100, line 402 would overlay slope 412 while work vehicle 100 was on that portion of profile 400. As work vehicle 100 continues to operate, it may continue to create a series of plateaus and slopes as in encounters ground features and controller 138 commands movement of blade 142 to counteract these ground features.

Figure 6:
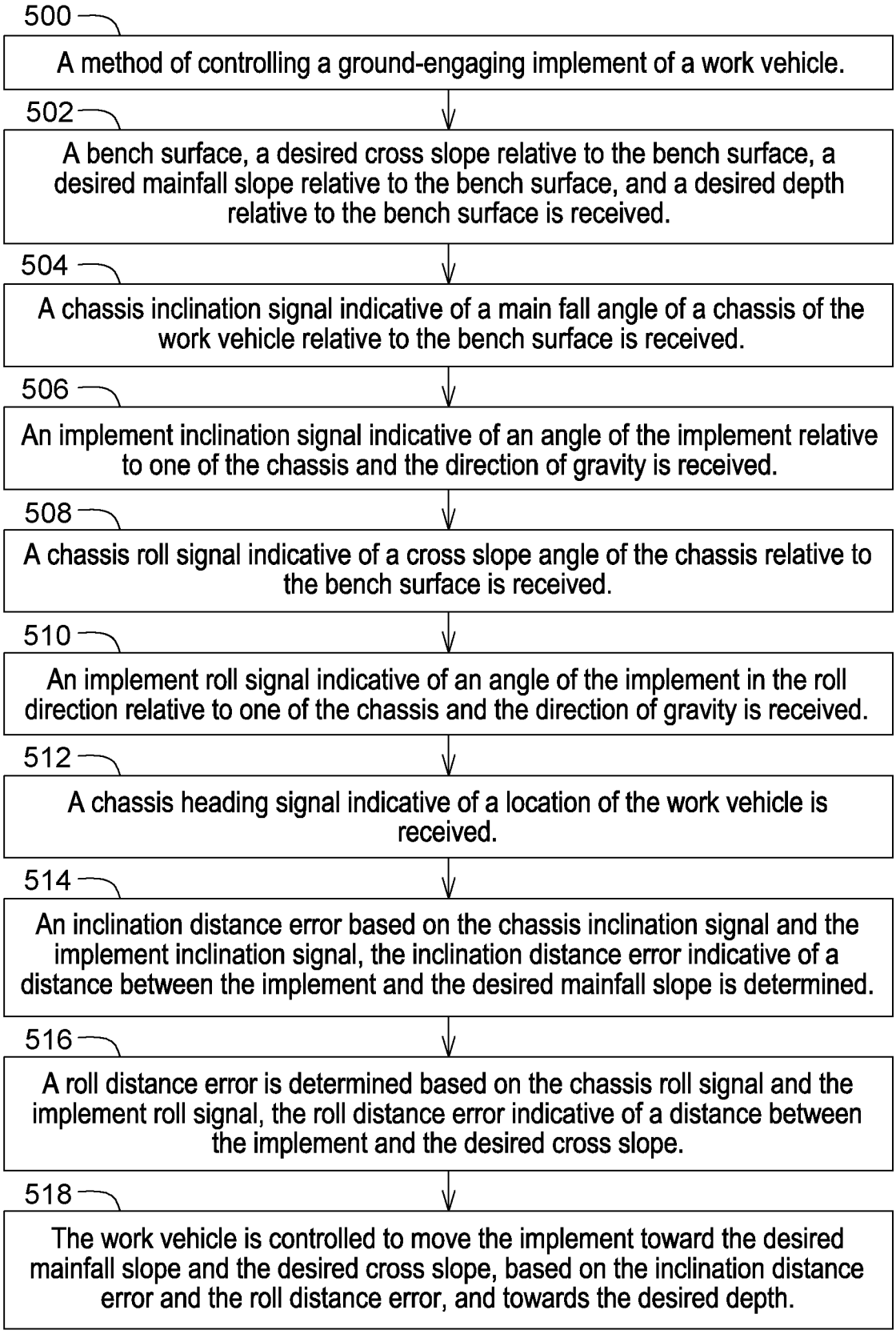
FIG. 6 is a flowchart of a method of actuating the blade of the crawler to create a target grade.

FIG. 6 is a flowchart of a method 500 of controlling a ground-engaging implement 141 of a work vehicle 100. In step 502, a bench surface 154, a desired cross slope 158 relative to the bench surface 154, a desired mainfall slope 160 relative to the bench surface 154, and a desired depth 162 relative to the bench surface 154 is received. In step 504, a chassis inclination signal 152 indicative of a main fall angle of a chassis 140 of the work vehicle 100 relative to the bench surface 154 is received. In step 506, an implement inclination signal 172 indicative of an angle of the implement 141 relative to one of the chassis 140 and the direction of gravity is received. In step 508, a chassis roll signal 164 indicative of a cross slope angle of the chassis 140 relative to the bench surface 154 is received. In step 510, an implement roll signal 174 indicative of an angle of the implement 141 in the roll direction relative to one of the chassis 140 and the direction of gravity is received. In step 512, a chassis heading signal 148 indicative of a location 150 of the work vehicle 100 is received. In step 514, an inclination distance error 178 based on the chassis inclination signal 152 and the implement inclination signal 172, the inclination distance error 178 indicative of a distance between the implement 141 and the desired mainfall slope 160 is determined. In step 516, a roll distance error 180 is determined based on the chassis roll signal 164 and the implement roll signal 174, the roll distance error 180 indicative of a distance between the implement 141 and the desired cross slope 158. In step 518, the work vehicle 100 is controlled to move the implement 141 toward the desired mainfall slope 160 and the desired cross slope 158, based on the inclination distance error 178 and the roll distance error 180, and towards the desired depth 162.

Figure 7:
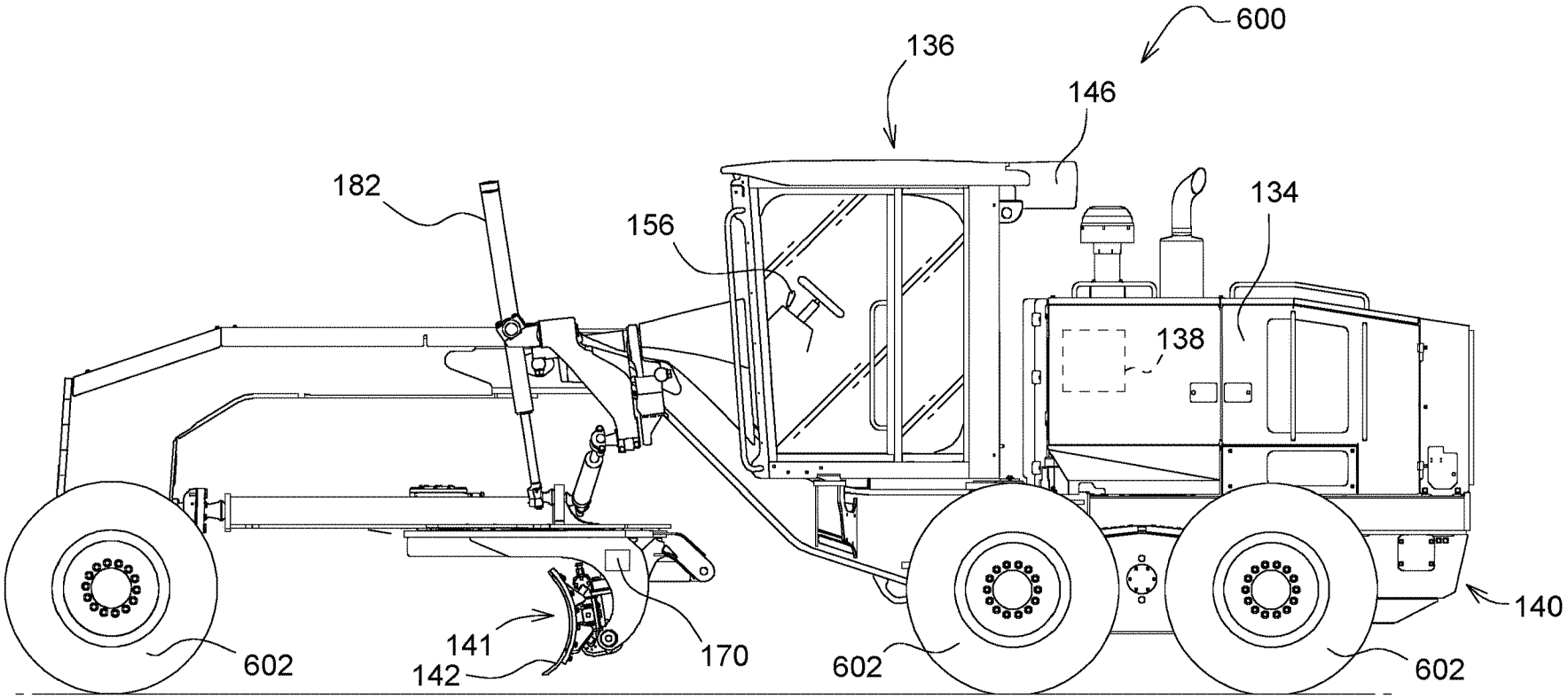
FIG. 7 is a left side view of a work vehicle, for example a motor grader.

FIG. 7 shows another work vehicle 100 that may be used for similar operations or tasks as the crawler 101, which is a motor grader 600. The motor grader 600 includes a chassis 140 that is supported by wheels 602. The motor grader 600 includes an implement 141 depicted as a blade 142. The implement may be lifted with lift cylinders 182. The motor grader 600 is powered by an engine 134. The motor grader 600 includes an operator station 136 that includes an input device 156. The motor grader 600 includes a chassis sensor 144 that may be a GPS 146 and an implement sensor 170 that is in communication with a controller 138.

While the disclosure has been illustrated and described in detail in the drawings and foregoing description, such illustration and description is not restrictive in character, it being understood that illustrative embodiment(s) have been shown and described and that all changes and modifications that come within the spirit of the disclosure are desired to be protected.

Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A work vehicle comprising:

a chassis;

a ground-engaging implement movably connected to the chassis via a linkage assembly configured to allow the implement to be raised and lowered relative to the chassis and moved in a roll direction relative to the chassis;

an input device for providing a bench surface, a desired cross slope relative to the bench surface, a desired mainfall slope relative to the bench surface, and a desired depth relative to the bench surface;

a global positioning system communicatively coupled to the work vehicle, the global positioning system configured for generating a chassis heading signal indicative of a location of the work vehicle, a chassis inclination signal indicative of a main fall angle of the chassis relative to the bench surface, and a chassis roll signal indicative of a cross slope angle of the chassis relative to the bench surface;

an implement sensor configured to provide an implement inclination signal indicative of an angle of the implement relative to one of the chassis and the direction of gravity and an implement roll signal indicative of an angle of the implement in the roll direction relative to one of the chassis and the direction of gravity; and a controller configured to:

receive the bench surface, the desired cross slope, the desired mainfall slope, and the desired depth;

receive the chassis heading signal, the chassis inclination signal, and the chassis roll signal;

receive the implement inclination signal and the implement roll signal;

determine an inclination distance error based on the chassis inclination signal and the implement inclination signal, the inclination distance error indicative of a distance between the implement and the desired mainfall slope;

determine a roll distance error based on the chassis roll signal and the implement roll signal, the roll distance error indicative of a distance between the implement and the desired cross slope; and send a command to move the implement toward the desired mainfall slope and the desired cross slope, based on the inclination distance error and the roll distance error, and towards the desired depth.

2. The work vehicle of claim 1, wherein the implement sensor comprises at least one accelerometer and at least one gyroscope.

3. The work vehicle of claim 1, wherein the implement sensor comprises an IMU.

4. The work vehicle of claim 1, wherein the linkage assembly is configured to allow the implement to be moved in a yaw direction.

5. The work vehicle of claim 1, wherein the implement comprises a blade.

6. The work vehicle of claim 1, wherein the work vehicle is a crawler.

7. The work vehicle of claim 1, wherein the work vehicle is a motor grader.

8. The work vehicle of claim 1, wherein the implement sensor is coupled to the implement.

9. A method of controlling a ground-engaging implement of a work vehicle comprising:

receiving a bench surface, a desired cross slope relative to the bench surface, a desired mainfall slope relative to the bench surface, and a desired depth relative to the bench surface;

receiving a chassis inclination signal indicative of a main fall angle of a chassis of the work vehicle relative to the bench surface;

receiving an implement inclination signal indicative of an angle of the implement relative to one of the chassis and the direction of gravity;

receiving a chassis roll signal indicative of a cross slope angle of the chassis relative to the bench surface;

receiving an implement roll signal indicative of an angle of the implement in the roll direction relative to one of the chassis and the direction of gravity;

receiving a chassis heading signal indicative of a location of the work vehicle;

determining an inclination distance error based on the chassis inclination signal and the implement inclination signal, the inclination distance error indicative of a distance between the implement and the desired mainfall slope;

determining a roll distance error based on the chassis roll signal and the implement roll signal, the roll distance error indicative of a distance between the implement and the desired cross slope; and controlling the work vehicle to move the implement toward the desired mainfall slope and the desired cross slope, based on the inclination distance error and the roll distance error, and towards the desired depth.

10. The method of claim 9, wherein the work vehicle is a crawler.

11. The method of claim 9, wherein the work vehicle is a motor grader.

12. A crawler comprising:

a chassis;

a ground-engaging implement movably connected to the chassis by a linkage assembly configured to allow the implement to be raised and lowered relative to the chassis and moved in a roll direction relative to the chassis;

a hydraulic cylinder;

an electrohydraulic valve assembly configured to move the implement by directing hydraulic fluid to the hydraulic cylinder;

an input device for providing a bench surface, a desired cross slope relative to the bench surface, a desired mainfall slope relative to the bench surface, and a desired depth relative to the bench surface;

a global positioning system communicatively coupled to the crawler, the global positioning system configured for generating a chassis heading signal indicative of a location of the crawler, a chassis inclination signal indicative of a main fall angle of the chassis relative to the bench surface, and a chassis roll signal indicative of a cross slope angle of the chassis relative to the bench surface;

an implement sensor coupled to the implement configured to provide an implement inclination signal indicative of an angle of the implement relative to one of the chassis and the direction of gravity and an implement roll signal indicative of an angle of the implement in the roll direction relative to one of the chassis and the direction of gravity; and a controller configured to:

receive the bench surface, the desired cross slope, the desired mainfall slope, and the desired depth;

receive the chassis heading signal, the chassis inclination signal, and the chassis roll signal;

receive the implement inclination signal and the implement roll signal;

determine an inclination distance error based on the chassis inclination signal and the implement inclination signal, the inclination distance error indicative of a distance between the implement and the desired mainfall slope;

determine a roll distance error based on the chassis roll signal and the implement roll signal, the roll distance error indicative of a distance between the implement and the desired cross slope; and send a command to the electrohydraulic valve assembly to move the implement toward the desired mainfall slope and the desired cross slope, based on the inclination distance error and the roll distance error, and towards the desired depth.

13. The crawler of claim 12, wherein the implement sensor comprises at least one accelerometer and at least one gyroscope.

14. The crawler of claim 12, wherein the implement sensor comprises an IMU.

15. The crawler of claim 12, wherein the implement sensor is coupled to the implement.

16. The crawler of claim 12, wherein the linkage assembly is configured to allow the implement to be moved in a yaw direction.

17. The crawler of claim 12, wherein the implement comprises a blade.

* * * * *